US006709341B1

(12) United States Patent
Giles

(10) Patent No.: US 6,709,341 B1
(45) Date of Patent: Mar. 23, 2004

(54) WHEEL-CHAIR ACCESSIBLE BILLIARD TABLE

(76) Inventor: Duane D. Giles, P.O. Box 1634, Ogden, UT (US) 84402

( * ) Notice: Subject to any disclaimer, the term of this patent is extended or adjusted under 35 U.S.C. 154(b) by 0 days.

(21) Appl. No.: 09/905,725

(22) Filed: Feb. 1, 2000

(51) Int. Cl.[7] ..... A63D 15/00; A63D 13/00

(52) U.S. Cl. ..... 473/4; 473/1; 473/28

(58) Field of Search ..... 473/1, 4, 8, 9, 473/10, 14, 22, 29, 31, 32, 33, 496, FOR 113; 273/309, 108, 113, 123 R; 108/150, 11, 144.11; 248/188.5, 188.8, 346.01, 346.05, 346.07

(56) References Cited

U.S. PATENT DOCUMENTS

| | | | | | |
|---|---|---|---|---|---|
| 383,228 | A | * | 5/1888 | Jones | 473/1 |
| 646,264 | A | * | 3/1900 | Collins | 473/10 |
| 675,273 | A | * | 5/1901 | Fuller | 473/16 |
| 735,995 | A | * | 8/1903 | Mumford | 473/15 |
| 1,528,287 | A | * | 3/1925 | Ajello | 473/1 |
| 1,840,203 | A | * | 1/1932 | Kimball | 473/10 |
| 1,967,217 | A | * | 7/1934 | Amsden | 473/1 |
| 3,438,629 | A | * | 4/1969 | Stengel et al. | 473/28 |
| 3,658,328 | A | * | 4/1972 | Kooker | 473/22 |
| 3,831,941 | A | * | 8/1974 | Norman | 473/477 |
| 4,679,509 | A | * | 7/1987 | Sampson, Jr. | 108/27 |
| 4,768,781 | A | * | 9/1988 | McMillin | 473/16 |
| 4,989,863 | A | * | 2/1991 | Hall | 473/15 |

* cited by examiner

*Primary Examiner*—Steven Wong
*Assistant Examiner*—Mitra Aryanpour
(74) *Attorney, Agent, or Firm*—Fehr Law Firm; Thompson E. Fehr

(57) ABSTRACT

A wheel chair-accessible billiard table having a table top with a bottom being substantially parallel to the upper surface of the table top, smooth, and free of any obstruction. A central support column is below the table top, and the central support column is on a base. The central support column has dimensions such that the large wheels and pilot wheels of a wheel chair as well as the arm rests of a wheel chair can be moved under the bottom of said table top, and the base is low enough to avoid the foot rests of a wheel chair while also having lateral dimensions such that a foot rest of a wheel chair will contact the central support column before a pilot wheel of the wheel chair contacts the base.

9 Claims, 5 Drawing Sheets

WHEEL-CHAIR ACCESSIBLE BILLIARD TABLE

BACKGROUND OF THE INVENTION

1. Field of the Invention

This invention relates to a billiard table that can be used by an individual who is utilizing a wheel chair.

2. Description of the Related Art

Billiard tables have been known for many years. The standard billiard table cannot, however, be utilized by one sitting in a wheel chair.

Players in wheel chairs have to struggle to make shots that could easily be made by a standing player. This is largely because a standard billiard table prevents a player in a wheel chair from"facing up" to a shot because their chairs and knees are blocked by the traditional billiard table. The player in a wheel chair usually must sit sideways or use a bridge to make a straight-on shot. Furthermore, the underneath edges of the traditional or standard billiard table are large, coarse, and rough so that they can tear clothing and inflict injury to legs which have no feeling.

In summary, the traditional billiard table lacks clearance under the table for wheel chairs and the legs of one occupying a wheel chair, possesses a rough configuration under the billiard table which can cause injury, has rigid pockets that present barriers to a player in a wheel chair, employs table legs which prevent movement of a wheel chair under the edge of the table, and uses a mainframe and decorative aprons that prevent access by a wheel chair.

U.S. Pat. No. 4,768,781 discloses a game table that rises from a central column. The construction of that game table is, however, not such as to create a true, stable playing surface. Moreover, the base t which the column is fastened would contact the pilot (front) wheels of a wheel chair well be ore the foot rest of the wheel chair would reach the column, thereby minimizing the ability of the player to get near or extend the player's body partially over the playing surface, as is often done in the game of billiards.

BRIEF SUMMARY OF THE INVENTION

The present invention supports the playing surface (table top) of a billiard table with a central support column.

The column is of dimensions such that forward clearance of the footrest of a wheel chair (and, consequently, the player-occupant's knees) and vertical clearance for the seat of the wheel chair meet the requirements of the Americans with Disabilities Act. Furthermore, the large wheels and pilot wheels of the wheel chair as well as the arm rests of the wheel chair can be moved under the bottom of the table top, providing lap clearance that complies with the Americans with Disabilities Act.

Notably, a base upon which the central support column preferably rests and to which the central support column is preferably attached, is low enough to avoid the foot rests of a wheel chair and has lateral dimensions only slightly larger than those of the central support column so that the foot rest of a wheel chair will contact the central support column before the pilot wheels of the wheel chair contact the base.

The preceding is accomplished while maintaining the playing surface of the billiard table at a traditional or standard playing height.

And trueness as well as thinness of the top of the table is achieved through the use of a layer of slate bolted to a wooden layer.

DETAILED DESCRIPTION OF THE INVENTION

Figure 1:
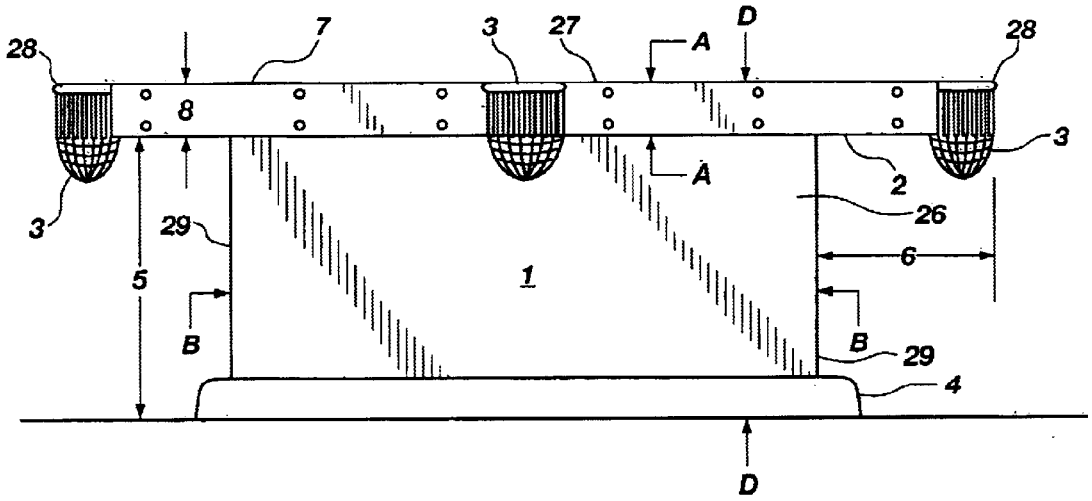
FIG. 1 is a lateral view from a side of the Wheel Chair-accessible Billiard Table.
Figure 2:
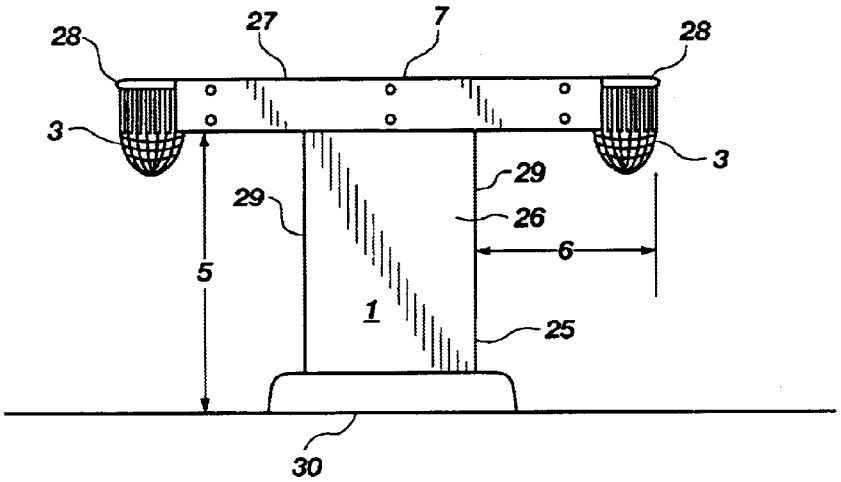
FIG. 2 is a lateral view from an end of the Wheel Chair-accessible Billiard Table.

As portrayed in FIG. 1 and FIG. 2, the Wheel Chair-accessible Billiard Table has a table top 7 on a central support column 26. The central support column 26 is placed on a base 4.

Figure 7:
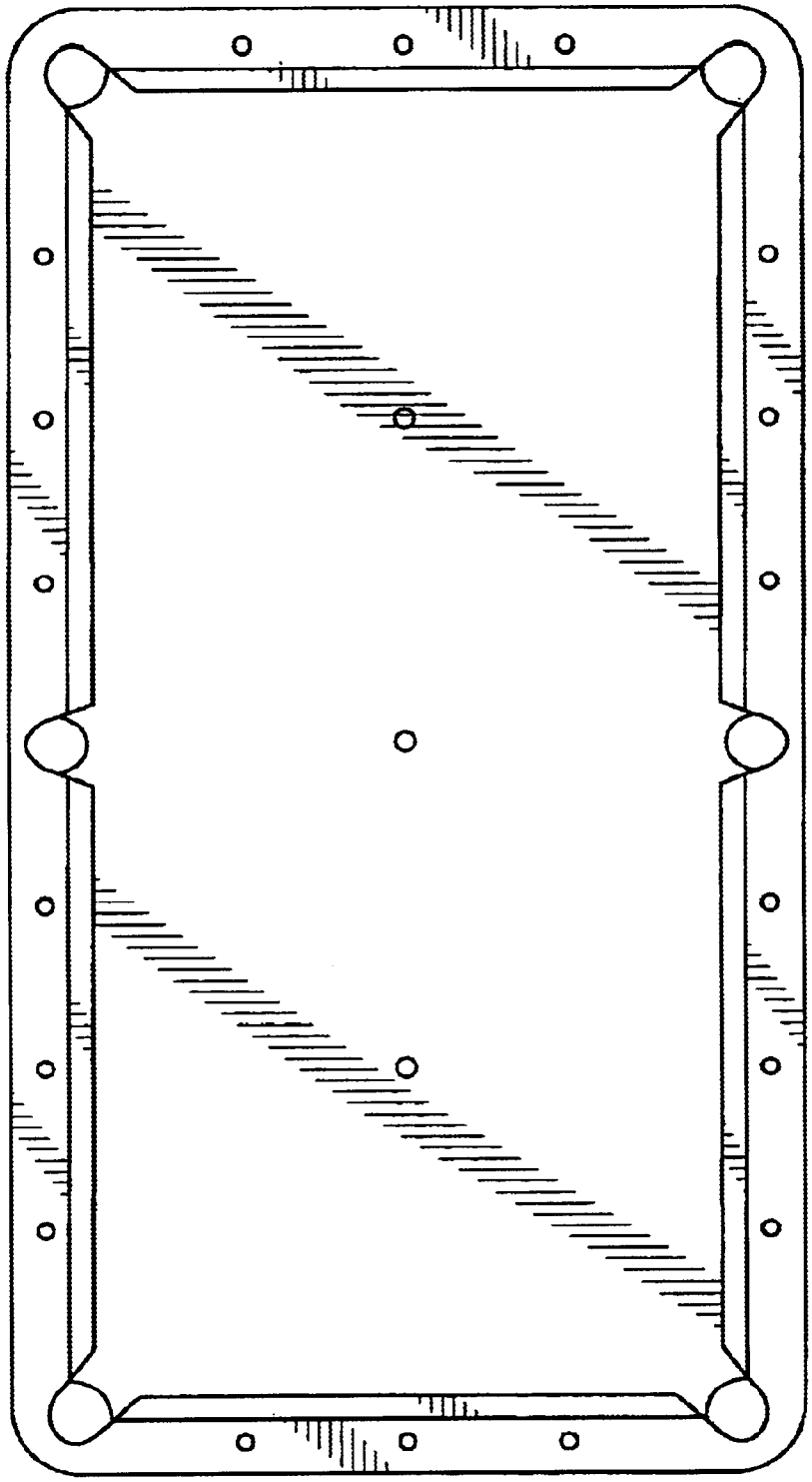
FIG. 7 (PRIOR ART)
FIG. 7 is a plan view of a traditional billiard table.

The upper or playing surface 27 of the table top 7 has the traditional configuration depicted in FIG. 7.

The pockets 3 attached to the table top 7 are soft and moveable so that they will fold out of the way upon contact with a player's knees or a wheel chair.

As mentioned above, the central support column 26 and the base 4 are of dimensions such that forward clearance of the footrest of a wheel chair (and, consequently, the player-occupant's knees) and vertical clearance for the seat of the wheel chair meet the requirements of the Americans with Disabilities Act. Thus, the large wheels and pilot wheels of a wheel chair as well as the arm rests of the wheel chair can be moved under the bottom 2 of the table top 7.

The distance 6 between the edge 28 of the table top 7 and the lateral surface 29 of the central support column 26 is at least 19 inches and, preferably is 19 inches.

Figure 3:
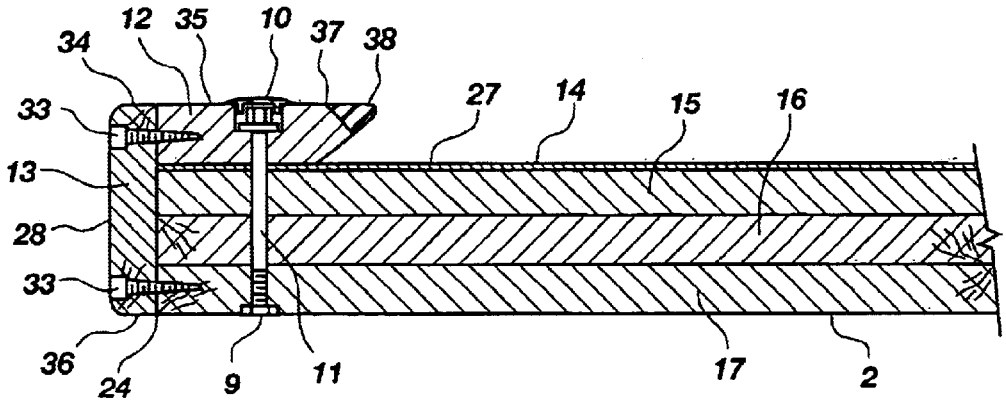
FIG. 3 is a cross-sectional view of the top of the Wheel Chair-accessible Billiard Table taken along lines A—A in FIG. 1.

Additionally, the table top 7 is, as illustrated in FIG. 3, preferably constructed of a layer of felt 14 having a layer of slate 15 underlying the layer of felt with a first layer of wood 16 below the layer of slate 15 and a second layer of wood 17 under said first layer of wood 16. A rail 12 lies on top of the layer of felt 14 adjacent to the edge 28, and bolts 11 preferably hold the rail 12 and the various layers 14, 15, 16, and 17 together. This enables the table top 7 to maintain trueness while also being thin enough (preferably a distance 8 of 5 and ⅛ inches) that the upper surface 27 of the table top 7 is at a traditional or standard playing height while the vertical clearance discussed above is also achieved. The bottom 2 of the table top 7 is at least a distance 5 of 27 inches and, preferably is 27 inches, from the bottom 30 of the base 4.

Bolting of the rail 12 also helps to assure that the rail 12 will not loosen when wheel chair players utilize the rail 12 to pull themselves around the Wheel Chair-accessible Billiard Table during a game.

Adjacent to an inner edge 37 of the rail 12 is a side cushion 38.

Also as discussed above, the base 4 is low enough, preferably no greater than 2.5 inches in height and most preferably 2.5 inches in height, to avoid the foot rests of a wheel chair and has lateral dimensions only slightly larger than those of the central support column 26 so that the foot rest of a wheel chair will contact the central support column 26 before the pilot wheels of the wheel chair contact the base 4.

Figure 4:
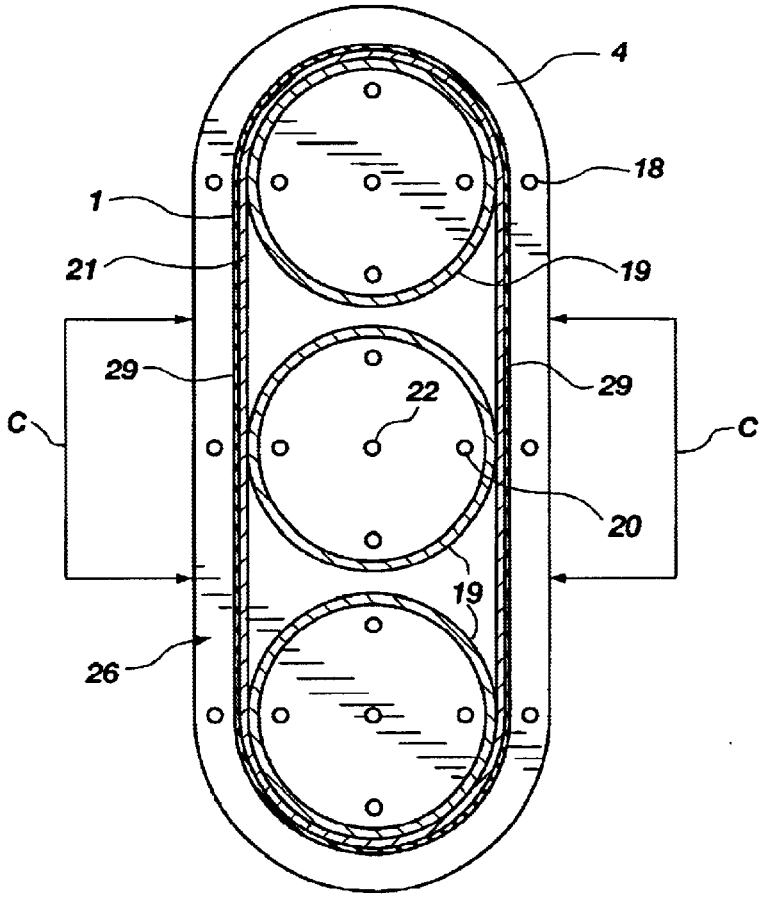
FIG. 4 is a cross-sectional view of a preferred construction of the central support column for the Wheel Chair-accessible Billiard Table taken along lines B—B in FIG. 1.

As shown in FIG. 4, the central support column 26 preferably comprises two or more, preferably three, support tubes 19. Preferably, a backer 21 encloses all the support tubes 19. Also preferably, the backer 21 is composed of plywood and is ¼ inch thick.

Figure 5:
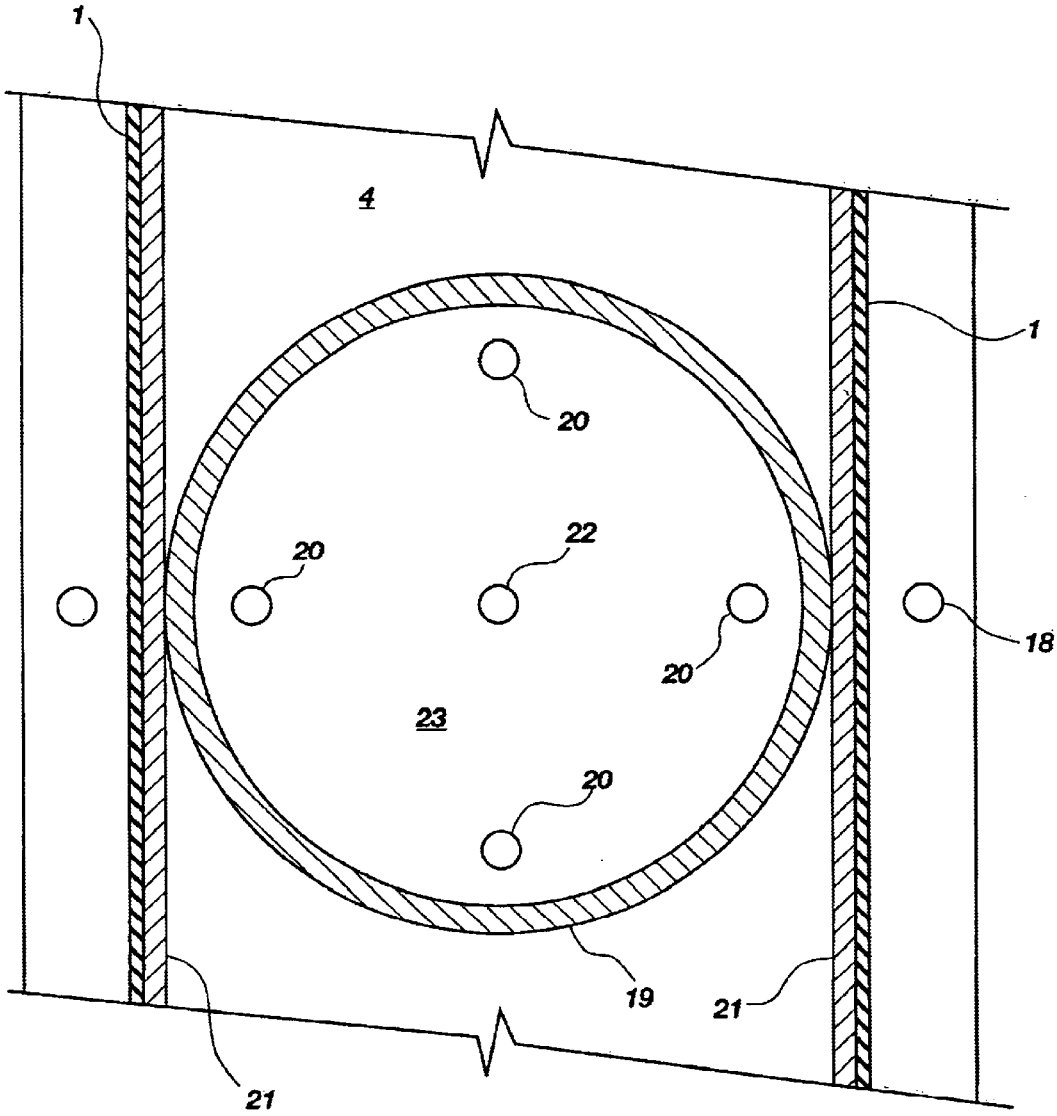
FIG. 5 is a cross-sectional view of an interior support tube in a preferred construction of the central support column.
Figure 6:
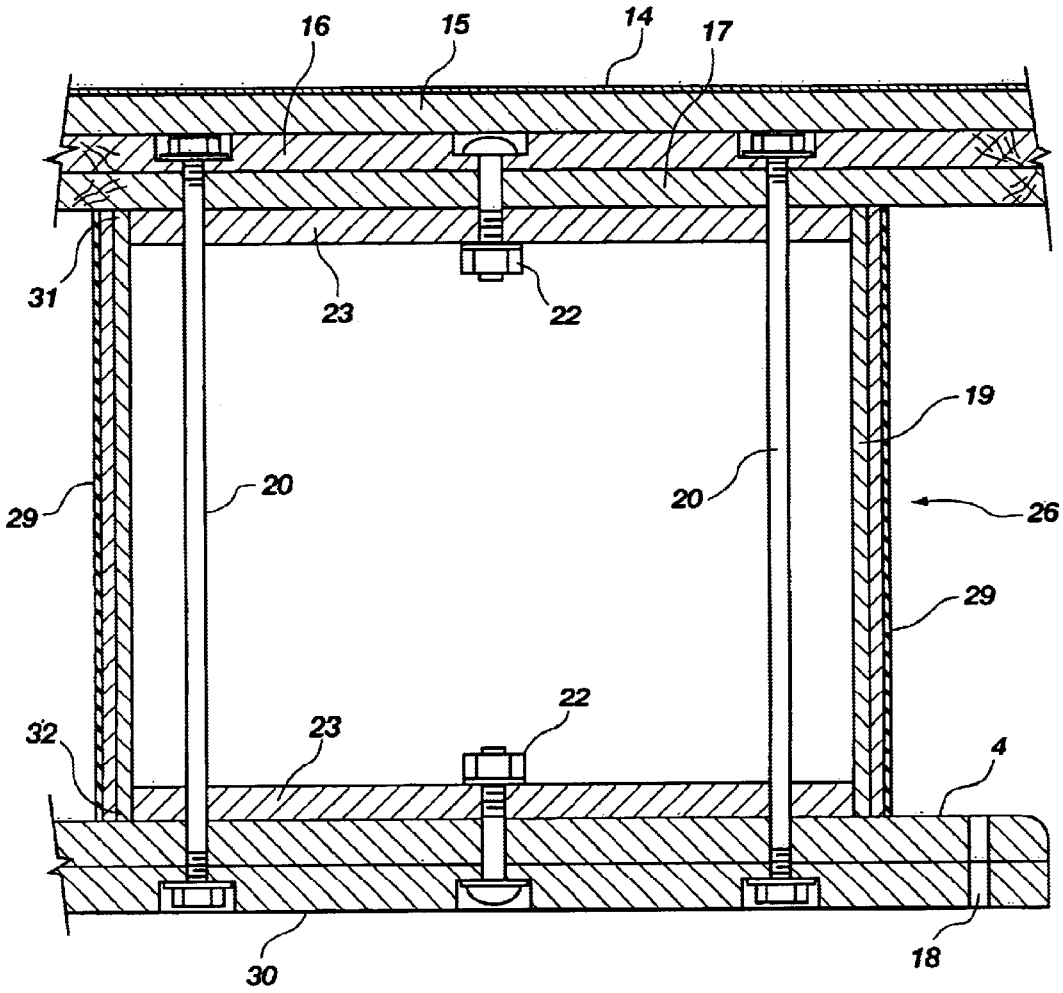
FIG. 6 is a cross-sectional view of a preferred construction of the central support column for the Wheel Chair-accessible Billiard Table taken along lines D—D in FIG. 1.

As seen in FIG. 5 and FIG. 6, each support tube 19 has a retaining plate 23 at the top end 31 of the support tube 19 and also at the bottom end 32 of the support tube 19. Preferably each support tube 19 has a thickness of 1 and ¼ inches.

At least one bolt 22 connects the two layers of wood 16, 17 to the retaining plate 23 at the top 31 of the support tube 19, and at least one bolt 22 connects the base 4 to the retaining plate 23 at the top 32 of the support tube 19. Additionally, at least one, and preferably four, bolts 20 connect the first layer of wood 16 to the base 4.

Preferably, a pad 1 covers the backer 21 of the central support column 26.

The base 4 preferably contains one or more apertures 18 for bolting the base 4 to a floor.

The bottom 2 of the table top 7 is substantially parallel, and is preferably parallel, to the upper surface 27 of the table top 7 and is preferably smooth. Furthermore, the bottom 2 is, from the edge 28 of the table top 7 to the surface 29 of the central support column 26 free of any obstruction.

Preferably, between the pockets 3 the edge 28 of the table top 7 is comprised of side caps 13 attached, preferably with fasteners 33, to the rail 12 and one of the layers of wood 16, 17 and preferably having a top 34 that is level with the top 35 of the rail 12 and a bottom 36 that is level with the bottom 2 of the table top 7.

Also preferably, all fasteners 33 and 11, 20, 22 are countersunk; and, preferably, plastic caps 10, which also serve as division spots, are placed on the rail 12 above each bolt 11.

The Wheel Chair-accessible Billiard Table preferably complies with the BCA Equipment Specifications, which require the following:

Table sizes:

Pocket Billiard Tables . . . 4 by 8 and 4 ½ by 9

Carom Billiard Tables . . . 4 ½ by 9 and 5 by 10

American Snooker Tables . . . 4 ½ by 9 and 5 by 10

Playing Area:

Measured from the cloth-covered nose of cushion rubber to the opposite cushion rubber, both width and length:

4 by 8 table . . . playing area 44-inch width by 88-inch length 4 by 8 table . . . playing area of 46-inch width by 92-inch length 4 ½ by 9 table . . . playing area of 56-inch width by 112-inch length BCA will sanction Tournament Play on Home and Coin-operated tables produced in sizes other than those recognized above, if the playing area width is one-half the length, measured cushion to opposite cushion.

Table Bed Height:

The table bed playing surface, when measured from the bottom of the table leg, will be 29 ½ inches minimum to 31 ½ inches maximum.

Pocket Openings and Measurements:

Pocket billiard tables: pocket openings are measured at two points—the first being measured between opposing cushion noses where the direction changes into the pocket (tip to tip). This is called the mouth. The second point of measurement is at the narrowest point at the back of the facing. This is called the throat.

Comer Pocket: Mouth . . . 4 ⅞-inch minimum to 5 ⅛-inch maximum

Throat . . . 4-inch minimum to 4 ¼-inch maximum

Side Pocket: Mouth . . . 5 ⅛-inch minimum to 5 ⅝-inch maximum

Throat . . . 4 ⅜-inch minimum to 4 ⅝-inch maximum

Vertical Pocket Angle 12±1 Degree

Shelf: The shelf is measured from the center of the imaginary line that goes from one side of the mouth to the other where the nose of the cushion changes direction to the center of the vertical cut of the slate pocket radius.

Shelf: Corner Pocket . . . 1 ⅝-inch minimum to 1 ⅞-inch maximum

Side Pocket . . . 0-inch minimum to ⅜-inch maximum

Drop Point Slate Radius: The pocket radius measured from the vertical cut of the slate to the playing surface.

Drop Point Slate Radius . . . ⅛-inch r. minimum to ¼-inch r. maximum

Playing Bed:

The playing surface must be capable, either by its own strength or a combination of its strength and that of the table baseframe, of maintaining an overall flatness within±0.020 inch lengthwise and 0.010 inch across the width. Further, this surface should have an additional deflection not to exceed 0.030 inch when loaded with a concentrated static force of 200 pounds at its center. If more than one slab is employed, the slab joints must be in the same plane within 0.005 inch after leveling and shimming. The bed must be covered with a billiard fabric, the major portion of which is made of wool, with proper tension to avoid unwanted ball roll-off. Commercial tables must have a three-piece set of one-inch slate with a wooden frame of at least ¼ inch attached to slate. All playing surfaces must be secured t base frame with screws or bolts.

Cushion:

Rubber cushions should be triangular in shape and molded with the conventional K-66 profile with a base of 1 1/16 inch and a nose height of 1 inch, with control fabric molded to the top and base area of the cushion. On carom billiard tables, the triangular K055 profile cushion is to be maintained, with the control fabric on the underside of the cushion to effect a slower rebound action. On snooker tables, the triangular K66 profile or L-shaped snooker cushion is to be used. The balance of the rail section to which the rubber cushion is glued should be of hardwood construction and attached to the slate bed with a minimum of three (3) heavy duty, threaded rail bolts per rail.

I claim:

1. A wheel chair-accessible billiard table which comprises:

a table top having an edge, and upper surface, and a bottom with the bottom being substantially parallel to the upper surface, smooth, and free of any obstruction, said table top further comprising:

a layer of felt;

a layer of slate under said layer of felt;

a first layer of wood below said layer of slate;

a second layer of wood under said first layer of wood; and a rail, having an inner edge, on top of said layer of felt and adjacent to the edge of said table top;

soft, moveable pockets attached to said table top;

a side cushion adjacent to the inner edge of said rail;

a central support column below said table top, said central support column having a lateral surface and having dimensions such that the large wheels and pilot wheels of a wheel chair as well as the arm rests of a wheel chair can be moved under the bottom of said table top;

a base below said central support column, said base being low enough to avoid the foot rests of a wheel chair and having lateral dimensions such that a foot rest of a wheel chair will contact said central support column before a pilot wheel of the wheel chair contacts said base and said base having a bottom and a lateral surface; and at least one bolt which connects said table top to said base; and wherein:

the bottom of said table top is at least twenty-seven inches from the bottom of said base;

the lateral surface of said central support column is at least nineteen inches from the edge of said table top; and said base is no greater than 2.5 inches in height.

2. The wheel chair-accessible billiard table as recited in claim 1, further comprising:

one or more bolts that hold said rail to said layer of felt, said layer of slate, said first layer of wood, and said second layer of wood.

3. A wheel chair-accessible billiard table which comprises:

a table top having an edge, and upper surface, and a bottom with the bottom being substantially parallel to the upper surface, smooth, and free of any obstruction;

soft, moveable pockets attached to said table top;

a rail, having an inner edge, on top of said table top adjacent to the edge of said table top;

a side cushion adjacent to the inner edge of said rail;

a central support column below said table top, said central support column having a lateral surface and having dimensions such that the large wheels and pilot wheels of a wheel chair as well as the arm rests of a wheel chair can be moved under the bottom of said table top;

a base below said central support column, said base being low enough to avoid the foot rests of a wheel chair and having lateral dimensions such that a foot rest of a wheel chair will contact said central support column before a pilot wheel of the wheel chair contacts said base and said base having a bottom and a lateral surface; and at least one bolt which connects said table top to said base; and wherein:

the bottom of said table top is at least twenty-seven inches from the bottom of said base;

the lateral surface of said central support column is at least nineteen inches from the edge of said table top; and said base is no greater than 2.5 inches in height.

4. The wheel chair-accessible billiard table as recited in claim 3, further comprising:

one or more bolts for holding said rail to a layer of felt, a layer of slate, a first layer of wood, and a second layer of wood.

5. A wheel chair-accessible billiard table which comprises:

a table top having an edge, and upper surface, and a bottom with the bottom being substantially parallel to the upper surface, smooth, and free of any obstruction, said table top further comprising:

a layer of felt;

a layer of slate under said layer of felt;

a first layer of wood below said layer of slate;

a second layer of wood under said first layer of wood; and a rail, having an inner edge, on top of said layer of felt and adjacent to the edge of said table top;

soft, moveable pockets attached to said table top;

a side cushion adjacent to the inner edge of said rail;

a central support column below said table top, said central support column having a lateral surface and having dimensions such that the large wheels and pilot wheels of a wheel chair as well as the arm rests of a wheel chair can be moved under the bottom of said table top; and a base below said central support column, said base being low enough to avoid the foot rests of a wheel chair and having lateral dimensions such that a foot rest of a wheel chair will contact said central support column before a pilot wheel of the wheel chair contacts said base and said base having a bottom and a lateral surface; and wherein:

the bottom of said table top is at least twenty-seven inches from the bottom of said base;

the lateral surface of said central support column is at least nineteen inches from the edge of said table top; and said base is no greater than 2.5 inches in height.

6. The wheel chair-accessible billiard table as recited in claim 1, further comprising:

one or more bolts that hold said rail to said layer of felt, said layer of slate, said first layer of wood, and said second layer of wood.

7. A wheel chair-accessible billiard table which comprises:

a table top having an edge, and upper surface, and a bottom with the bottom being substantially parallel to the upper surface, smooth, and free of any obstruction;

soft, moveable pockets attached to said table top;

a rail, having an inner edge, on top of said table top adjacent to the edge of said table top;

a side cushion adjacent to the inner edge of said rail;

a central support column below said table top, said central support column having a lateral surface and having dimensions such that the large wheels and pilot wheels of a wheel chair as well as the arm rests of a wheel chair can be moved under the bottom of said table top; and a base below said central support column, said base being low enough to avoid the foot rests of a wheel chair and having lateral dimensions such that a foot rest of a wheel chair will contact said central support column before a pilot wheel of the wheel chair contacts said base and said base having a bottom and a lateral surface; and wherein:

the bottom of said table top is at least twenty-seven inches from the bottom of said base;

the lateral surface of said central support column is at least nineteen inches from the edge of said table top; and said base is no greater than 2.5 inches in height.

8. The wheel chair-accessible billiard table as recited in claim 7, further comprising:

one or more bolts for holding said rail to a layer of felt, a layer of slate, a first layer of wood, and a second layer of wood.

9. A wheel chair-accessible billiard table, which comprises:

a table top having an edge, and upper surface, and a bottom with the bottom being substantially parallel to the upper surface, smooth, and free of any obstruction, wherein said table top comprises:

a layer of felt;

a layer of slate under said layer of felt;

a first layer of wood below said layer of slate;

a second layer of wood under said first layer of wood; and a rail, having an inner edge, on top of said layer of felt and adjacent to the edge of said table top;

soft, moveable pockets attached to said table top;

a side cushion adjacent to the inner edge of said rail;

a central support column below said table top, said central support column having dimensions such that the large wheels and pilot wheels of a wheel chair as well as the arm rests of a wheel chair can be moved under the bottom of said table top, wherein the lateral surface of said central support column is at least nineteen inches from the edge of said table top;

a base below said central support column, said base being low enough to avoid the foot rests of a wheel chair and having lateral dimensions such that a foot rest of a wheel chair will contact said central support column before a pilot wheel of the wheel chair contacts said base and said base having a bottom and a lateral surface, wherein the bottom of said table top is at least twenty-seven inches from the bottom of said base and said base is no greater than 2.5 inches in height;

at least one bolt which connects said table top to said base; and one or more bolts that hold said rail to said layer of felt, said layer of slate, said first layer of wood, and said second layer of wood.

* * * * *